US006758667B2

(12) United States Patent
Wilson

(10) Patent No.: US 6,758,667 B2
(45) Date of Patent: Jul. 6, 2004

(54) CANDLEWICK WITH IMPROVED BURNING CAPABILITY

(75) Inventor: Mara L. Wilson, Taylor Mill, KY (US)

(73) Assignee: Atkins & Pearce, Inc., Covington, KY (US)

( * ) Notice: Subject to any disclaimer, the term of this patent is extended or adjusted under 35 U.S.C. 154(b) by 0 days.

(21) Appl. No.: 10/435,816

(22) Filed: May 12, 2003

(65) Prior Publication Data

US 2003/0211437 A1 Nov. 13, 2003

Related U.S. Application Data

(60) Provisional application No. 60/379,426, filed on May 10, 2002.

(51) Int. Cl.[7] ..... F23D 3/16
(52) U.S. Cl. ..... 431/325; 431/288
(58) Field of Search ..... 431/325, 289, 431/288

(56) References Cited

U.S. PATENT DOCUMENTS 652,548 A * 6/1900 Neustaedter ..... 431/325
984,029 A * 2/1911 Scheuble ..... 431/126
1,671,267 A * 5/1928 Atkins ..... 431/325
2,001,377 A * 5/1935 Candy, Jr. ..... 431/291
2,189,412 A * 2/1940 Arnone ..... 431/325
2,291,067 A * 7/1942 Atkins ..... 431/291
2,818,718 A * 1/1958 Roberts ..... 431/291
2,829,511 A * 4/1958 Oesterle ..... 431/325
3,940,233 A * 2/1976 Fox et al. ..... 431/325
5,124,200 A * 6/1992 Mallonee ..... 428/131
5,863,196 A * 1/1999 Rockwell et al. ..... 431/325
2003/0013060 A1 * 1/2003 Schoeck ..... 431/288

* cited by examiner

*Primary Examiner*—Carl D. Price
(74) *Attorney, Agent, or Firm*—Wood, Herron & Evans, LLP

(57) ABSTRACT

A candlewick for use in a candle system includes two or more wicks which are intertwined and at least one binding member, such as a generally non-wicking yarn, which holds the wicks intertwined. The binding member decomposes in response to heat generated by a single flame fueled by the wicks so that the wicks separate from each other to define a pair of wick ends which fuel the single flame.

11 Claims, 2 Drawing Sheets

CANDLEWICK WITH IMPROVED BURNING CAPABILITY

The present application claims the filing benefit of pending U.S. Provisional Application Serial No. 60/379,426, filed May 10, 2002, the disclosure of which is hereby incorporated herein by reference in its entirety.

FIELD OF THE INVENTION

The present invention relates generally to candle systems and, more particularly, to a candlewick for use in such candle systems for efficiently burning candle fuels.

BACKGROUND OF THE INVENTION

When a candle is burning, a problem of sooting occurs when the flame of the candle is incapable of efficiently burning the fuel that is being supplied to the flame via the wick. Soot is generally understood to be the remains of carbon particles that have not been completely decomposed (burned) within the candle flame as the candle burns. Soot has three directions it can go in a candle system. First, it can be fully combusted and burned off. Second, it can be released into the atmosphere as smoke. Lastly, it can attach itself to the candlewick and grow into a carbon head.

Soot in the form of smoke is typically associated with having a candlewick that is too large such that the flame is incapable of completely burning "all" of the fuel being supplied via the wick. This problem is usually remedied by using a smaller wick which will provide less fuel to the flame and thus prevent a candle from smoking. However, smaller flames produce less heat which is oftentimes necessary to completely oxidize carbon particles from the wick to prevent carbon heading. Therefore, the optimum solution is to find a wick that can supply the correct amount of fuel to the flame so that there is neither smoking nor carbon head formation as the candle burns.

Proper sizing of the wick for a particular candle application has been the preferred solution for centuries. Recently, however, the introduction and popularity of various natural and cleaner burning candle fuels, as well as the introduction of oversized and oddly shaped candles (opposed to the traditional cylinder shapes) has presented the need for vastly more sophisticated candlewick systems.

Accordingly, there is a need for a candlewick for use in a candle system which burns efficiently without producing undesirable smoke or forming a carbon head in a variety of candle system applications.

SUMMARY OF THE INVENTION

The present invention overcomes the foregoing and other shortcomings and drawbacks of candlewicks and candle systems heretofore known. While the invention will be described in connection with certain embodiments, it will be understood that the invention is not limited to these embodiments. On the contrary, the invention includes all alternatives, modifications and equivalents as may be included within the spirit and scope of the present invention.

In accordance with the principles of the present invention, a candlewick is provided which is particularly designed to burn efficiently in a candle system without producing undesirable smoke and carbon heading. Rather than simply adjusting the size of the wick (larger or smaller) to accommodate the flame's ability to consume the fuel supplied by the candle, the candlewick of the present invention is designed to change the physical shape of the flame to thereby find provide maximum burning efficiency.

To this end, and in accordance with one embodiment of the present invention, the candlewick comprises two or more discrete wicks which are braided, weaved, twisted or otherwise intertwined together so that the wicks are intertwined along their respective entire lengths. A binding member, such as one or more yarns of polypropylene or other generally non-wicking and non-toxic material, is intertwined with the wicks in one embodiment so that the wicks are bound together by the yarn and thereby prevented from uncoiling or unraveling before being incorporated into a candle system.

When the candlewick of the present invention is ignited, the heat generated by the flame melts or burns away the polypropylene yarns that are binding the wicks together. The individual wicks, which are no longer bound together, naturally unravel or uncoil away from each other generally at or slightly above the surface of the candle as the candlewick burns so that the ends of the wicks separate and spread apart. The single flame, which is now fed by two (or more) discrete wicks, is shaped by the unraveled or uncoiled ends of the wicks and the wick composition to produce an enlarged flame and flame base which are larger than the flame and flame base generated by a conventional single candlewick end of conventional candlewick systems. By having the particular wick construction and wick composition of the present invention define the size and shape of the enlarged flame, more oxygen is drawn into the flame, thereby providing for a larger heated burning chamber within the flame itself and reducing the generation of undesirable smoke and soot from the flame.

The above and other objects and advantages of the present invention shall be made apparent from the accompanying drawings and the description thereof.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

With reference to FIGS. 1–4, a candlewick 10 is shown in accordance with one embodiment of the present invention. As will be described in greater detail below, candlewick 10 is particularly constructed in accordance with the principles of the present invention to burn efficiently without producing undesirable smoke or forming a carbon head for a variety of candle applications.

Figure 1:
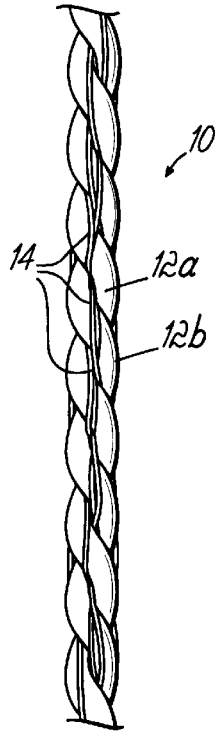
FIG. 1 is a diagrammatic top plan view of a candlewick in accordance with one embodiment of the present invention.

Referring now to FIG. 1, this new construction is obtained by braiding, weaving, twisting or otherwise intertwining two or more discrete wicks 12*a*, 12*b* together (two shown) so that the wicks 12*a*, 12*b* are intertwined along their entire respective lengths. As used herein, the terms "intertwined" and "intertwining" are intended to refer to the braiding, twisting, weaving, or otherwise close association of the two or more discrete wicks along their entire respective lengths.

In one embodiment, as shown in FIGS. 1–4, the wicks 12*a*, 12*b* are twisted in a spiral pattern around each other, although other intertwined patterns of the wicks 12*a*, 12*b* which are well known to those of ordinary skill in the art are possible as well without departing from the spirit and scope of the present invention. Each of the wicks 12*a*, 12*b* may comprise one or more filaments of rayon, linen, cotton, cellulose, a mixture thereof, or any other conventional wick material, and each wick 12*a*, 12*b* is constructed in a conventional manner well known to those of ordinary skill in the art.

In accordance with one embodiment of the present invention, one or more polypropylene or other generally non-wicking and non-toxic yarns 14 (FIGS. 1, 3 and 4) are intertwined with the wicks 12*a*, 12*b* in a conventional intertwining manner used by candle makers in the manufacture of candlewicks from two or more wicks so that the wicks 12*a*, 12*b* are bound together by the yarns 14 and thereby prevented from uncoiling or unraveling before being incorporated into a candle system. In this final intertwined configuration of the wicks 12*a*, 12*b* and the yarns 14, the candlewick 10 is prepared to be incorporated into a candle system to wick the fuel provided by the candle system as it burns during use.

It is contemplated that the yarns 14 may be intertwined with the wicks 12*a*, 12*b* as shown, and/or may be wrapped about the wicks 12*a*, 12*b* to bind the wicks together. It is also contemplated that yarns 14 may comprise a single filament or multiple filaments of material that are adapted to melt or burn away through heat generated by a candle flame, without the yarns 14 themselves generating undesirable smoke or soot, to thereby permit the wicks 12*a*, 12*b* to unravel or uncoil in accordance with the principles of the present invention. The candlewick 10 of the present invention may be used in a variety of candle systems including, without limitation, pillar candles, taper candles, jar candles, fragrance candles as well as candles that are oversized and oddly shaped.

Figure 2:
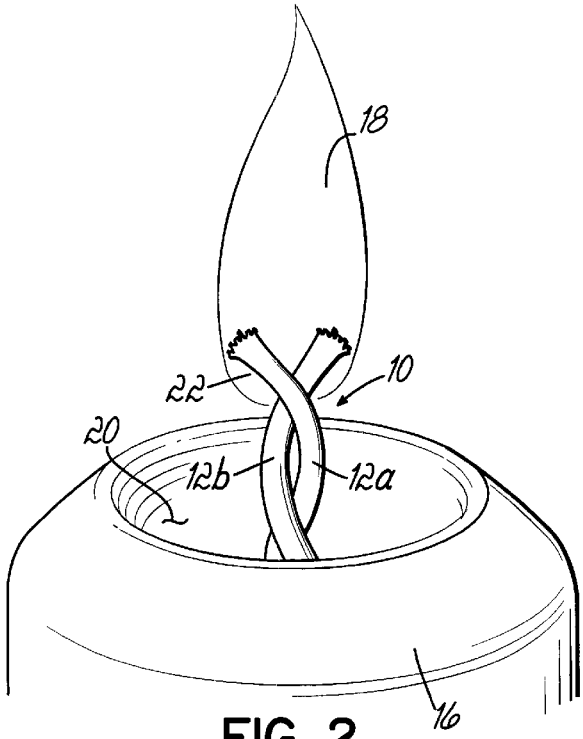
FIG. 2 is a partial perspective view of an exemplary candle burning the candlewick illustrated in FIG. 1.
Figure 3:
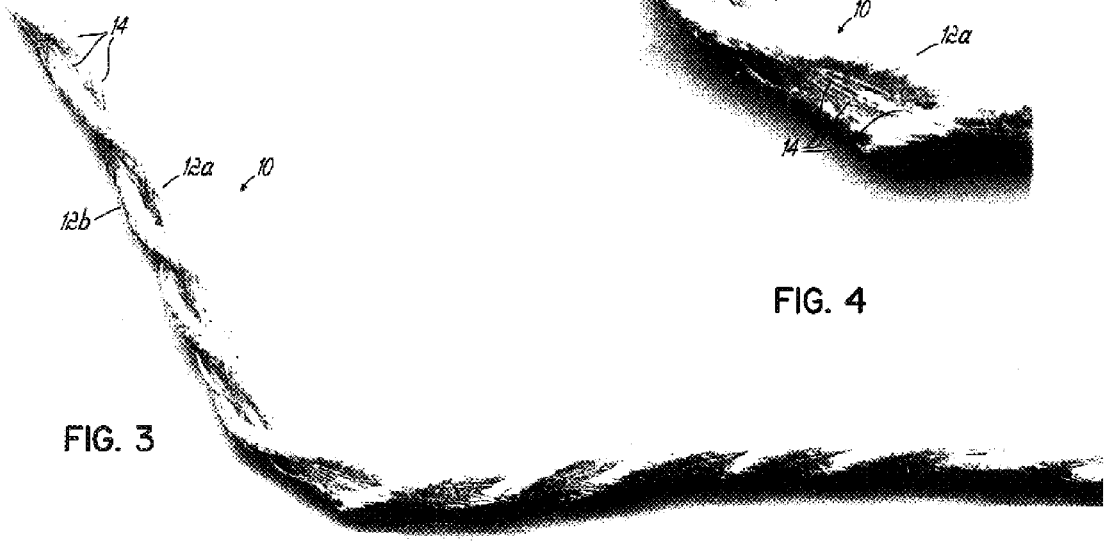
FIG. 3 is a color photograph showing the candlewick illustrated in FIG. 1.
Figure 4:
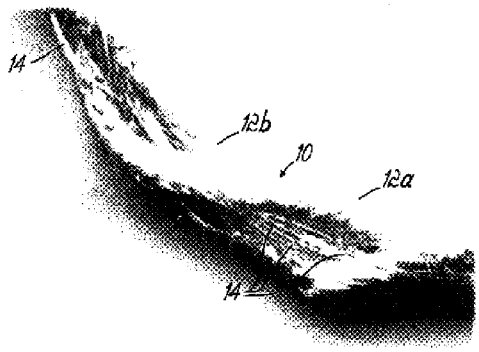
FIG. 4 is a color photograph similar to FIG. 3 showing additional detail of the candlewick illustrated in FIG. 1.

Referring now to FIG. 2, the candlewick 10 is shown extending from an exemplary candle 16. When the candlewick 10 is ignited, the heat generated by the flame 18 decomposes, i.e., melts or burns away the polypropylene yarns 14 that are binding the wicks 12*a*, 12*b* together. The individual wicks 12*a*, 12*b*, which are no longer bound together, naturally unravel or uncoil away from each other generally at or slightly above the surface 20 of the candle 16 as the candlewick 10 burns so that the ends of the wicks 12*a*, 12*b* separate and spread apart as shown in FIG. 2. The single flame 18, which is now fed by two (or more) discrete wicks 12*a*, 12*b* in accordance with the principles of the present invention, is shaped by the unraveled or uncoiled ends of the wicks 12*a*, 12*b* and the wick composition to produce an enlarged flame 18 and flame base 22 which are larger than the flame and flame base 22 generated by a conventional single candlewick end of conventional candlewick systems.

The candlewick 10 of the present invention is especially effective in candle systems where expanding the flame base is desired to achieve a larger wax pool without adding extra fuel drawing power to the wick. By having the particular wick construction and wick composition of the present invention define the size and shape of the enlarged flame 18, more oxygen is drawn into the flame 18, thereby providing for a larger heated burning chamber within the flame itself and reducing the generation of undesirable smoke and soot from flame. This oxygenation of the flame 18 assists in decomposing or completely burning the slower drawing viscous waxes without the reduction of flame size. The increased oxygenation provided by the enlarged flame 18 also assists in decomposing higher levels of dyes and fragrances in candles without producing the unusually large carbon heads associated with these types of candles.

While the present invention has been illustrated by a description of various embodiments and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of Applicant's general inventive concept.

Having described the invention, what is claimed is:

1. A candlewick, comprising:

an elongated first wick member comprising a wicking material;

an elongated second wick member comprising a wicking material and being intertwined with the first wick member; and at least one elongated binding member intertwined with the first and second wick members to hold the first and second wick members intertwined, wherein the binding member is operable to decompose in response to heat generated by a single flame fueled by the first and second wick members so that the first and second wick members separate from each other to define a pair of wick ends which fuel the single flame.

2. The candlewick of claim 1 wherein the binding member comprises a generally non-wicking material.

3. The candlewick of claim 2 wherein the binding member comprises at least one polypropylene yarn.

4. A candle system, comprising:

a combustible medium; and a candlewick in fluid communication with said combustible medium and having a free end extending above a surface of said combustible medium to generate a single flame when ignited, the candlewick comprising an elongated first wick member comprising a wicking material, an elongated second wick member comprising a wicking material and being intertwined with said first wick member, and at least one elongated binding member intertwined with the first and second wick members to hold the first and second wick members intertwined, wherein the binding member is operable to decompose in response to heat generated by the single flame fueled by the first and second wick members so that the first and second wick members separate from each other generally proximate the surface of the combustible medium to define a pair of wick ends which fuel the single flame.

5. The candlewick of claim 4 wherein the binding member comprises a generally non-wicking material.

6. The candlewick of claim 4 wherein the binding member comprises at least one polypropylene yarn.

7. A method of making a candlewick from an elongated first wick member comprising a wicking material and an elongated second wick member comprising a wicking material, comprising:

intertwining the first and second wick members; and intertwining at least one elongated binding member with the first and second wick members to hold the first and second wick members intertwined, wherein the binding member is operable to decompose in response to heat generated by a single flame fueled by the first end second wick members so that the first and second wick members separate from each other to define a pair of wick ends which fuel the single flame.

8. The method of claim 7 wherein the binding member comprises a generally non-wicking material.

9. The method of claim 7 further comprising the step of fluidly communicating the candlewick with a combustible medium.

10. The method of claim 9 wherein the combustible medium comprises a candle.

11. A product made by the method of claim 7.

* * * * *

UNITED STATES PATENT AND TRADEMARK OFFICE

CERTIFICATE OF CORRECTION

PATENT NO. : 6,758,667 B2
DATED : July 6, 2004
INVENTOR(S) : Mara L. Wilson

It is certified that error appears in the above-identified patent and that said Letters Patent is hereby corrected as shown below:

Column 5,
Line 8, change “first end second” to -- first and second --.

Signed and Sealed this

Twenty-first Day of September, 2004

JON W. DUDAS
*Director of the United States Patent and Trademark Office*